United States Patent [19]

Morrey

[11] 4,383,484

[45] May 17, 1983

[54] PRIMER ASSEMBLY

[75] Inventor: William B. Morrey, Brownsburg, Canada

[73] Assignee: CXA Ltd., North York, Canada

[21] Appl. No.: 205,422

[22] Filed: Nov. 10, 1980

[30] Foreign Application Priority Data

Dec. 7, 1979 [CA] Canada ..... 341463

[51] Int. Cl.[3] ..... C06C 5/04

[52] U.S. Cl. ..... 102/275.3; 102/275.7; 102/275.8; 102/275.11; 102/275.12; 102/313; 102/322; 102/331

[58] Field of Search ..... 102/275.3, 275.7, 275.8, 102/275.11, 275.12, 313, 317, 322, 331, 332

[56] References Cited

U.S. PATENT DOCUMENTS

| | | | |
|---|---|---|---|
| 3,058,419 | 10/1962 | O'Brien | 102/331 |
| 3,141,410 | 7/1964 | Gundlach et al. | 102/332 |
| 3,183,836 | 5/1965 | Griffith | 102/331 |
| 3,604,353 | 9/1971 | Newman | 102/332 |
| 3,955,504 | 5/1976 | Romney | 102/331 |
| 4,023,494 | 5/1977 | Barton et al. | 102/331 X |
| 4,060,034 | 11/1977 | Bowman et al. | 102/275.5 |
| 4,165,691 | 8/1979 | Bowman et al. | 102/322 |
| 4,178,852 | 12/1979 | Smith et al. | 102/322 |
| 4,295,424 | 10/1981 | Smith et al. | 102/322 |

FOREIGN PATENT DOCUMENTS

| | | | |
|---|---|---|---|
| 934224 | 9/1973 | Canada | 102/322 |

*Primary Examiner*—Peter A. Nelson

*Attorney, Agent, or Firm*—Donald G. Ballantyne

[57] ABSTRACT

A cast or pressed explosive primer is provided which is adapted for slidable initiating engagement with a detonating cord. The primer comprises two hermetically sealed shells or cups which are connected together. One shell contains a sensor/signal carrier/delay cap combination and the second shell contains the explosive primer charge. Guides are provided on the outside of the shells for the threading therethrough of a detonating cord. The construction provides protection against the ingress of water or other liquids which may desensitize the initiation system.

6 Claims, 7 Drawing Figures

PRIMER ASSEMBLY

This invention relates to the initiation of low sensitivity explosives in large diameter, vertical boreholes such as in open pit and underground mining and quarrying operations. In particular, the invention relates to an explosive primer assembly adapted for initiation by means of detonating cord and delay action blasting caps in vertical boreholes charged with a low sensitivity blasting agent.

To achieve the optimum use of explosive energy, to reduce ground vibrations, and to minimize any detrimental effects to the surrounding environment, it is now well known to employ time-delay blasting techniques. Briefly described, this kind of blasting involves the charging of a borehole or several boreholes with explosives and placing time-delay initiators at intervals along the explosive column. Such initiators may be electric blasting caps or, preferably, delay caps initiated by means of a low energy detonating cord. Generally the use of electric blasting caps is avoided for safety reasons and as a matter of convenience since a large number of electric lead wires are required for each borehole. Where the explosive charge employed is of the low sensitivity type, for example, bulk or packaged ammonium nitrate/fuel oil (ANFO) or aqueous slurry mixtures, it is also necessary to employ a primer or booster charge with each delay blasting cap in order to insure detonation of the relatively insensitive explosive.

Generally, the preferred method of charging a large diameter, vertical borehole for time-delay blasting purposes comprises the steps of placing a length of detonating cord as a down line throughout the length of a borehole and, as the borehole is charged with bulk or packaged explosives, primer charges each containing a non-electric delay cap, are slid down and in contact with the down line so that the fully charged borehole may contain several primers decked at intervals along its length. The delay cap in each of the primers is selected so as to provide the most efficient blasting results. Upon initiation of the detonating cord down line, the associated caps and primers are initiated in a planned time-delay sequence. Typical non-electric time delay blasting methods are described, for example, in U.S. Pat. No. 4,060,033 and U.S. Pat. No. 4,133,247.

In large scale quarrying, underground and open pit mining operations such as in iron ore pit mines, it is the common practise for reasons of economy to load a large number of boreholes with explosives over a period of several days or even weeks and to thereafter initiate nearly simultaneously all the charged boreholes to detonate in non-electric time-delay sequence. The employment of such mining methods frequently means that the explosive components in the borehole, including the initiating detonating cord lines, and the delay blasting caps and primers, are exposed for long periods of time to conditions of moisture or oil or other chemical contamination from the components of bulk explosives sufficient to cause desensitization of one or other of the delay blasting cap components. While methods have been developed to "waterproof" the explosive charge and the detonating cords, it has not been possible to provide complete insurance against moisture and oil desensitization for the blasting cap particularly at its point of connection to a length of detonating cord. This is a particular problem with the use of cap-initiated sliding primers of the types described in, for example, U.S. Pat. No. 4,060,033 and U.S. Pat. No. 4,133,247, since the initiating caps and/or sensors are exposed to the moisture or oil present in the borehole and may become desensitized resulting in a detonation failure. There remains a need, therefore, for a slider primer assembly of the type comprising a cast or pressed priming charge and an associated cord- or shock tube-initiated, time-delay cap which may be conveniently used in large diameter vertical boreholes and which can withstand the desensitizing effect of moisture or oil and pressure for long periods of time.

The primer assembly of the present invention provides an economic, convenient, non-electric down-the-hole sliding initiating primer device which resists moisture and oil penetration for long periods of time. Generally the invention comprises a first shell containing a priming explosive charge and a second shell containing a sensor/signal carrier/delay cap assembly, the said second shell being hermetically sealed and adapted for connection to said first shell. Aligned detonating cord tunnels, through which are passed a detonating cord downline, are affixed to or comprise an integral part of the outside of the said first and second shells. The sensor/signal carrier/delay cap assembly sealed within the said second shell is so arranged that the sensor is held in initiating relationship with the detonating cord downline passed through the adjacent tunnel. A shock wave generated by the detonation of the downline initiates the sensor thereby generating an energy pulse which is in turn transmitted by the signal carrier to initiate the delay cap. The initiation of the cap after a preset time-delay interval causes detonation of the primer explosive charge and, in turn, the adjacent blasting explosive in the borehole.

The invention will be particularly described by reference to the attached drawings wherein.

Figure 1:
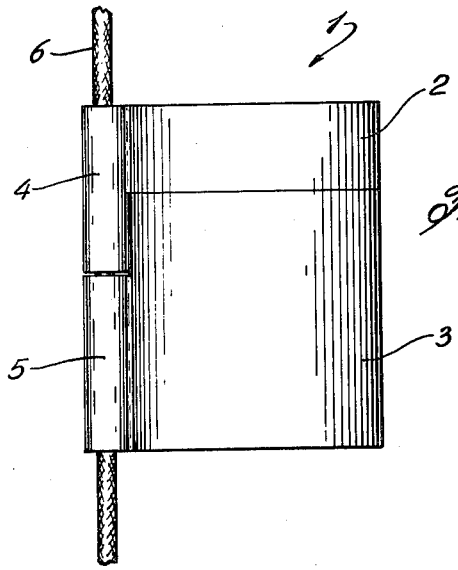
FIG. 1 is a side elevational view of the delay primer assembly of the present invention showing the assembled first and second shell units.

Referring to the figures of the drawings where like numbers are used to designate like parts, in FIG. 1, 1 represents the primer assembly of the invention consisting of an upper shell unit 2 and an adjacent interlocked lower shell unit 3. Upper shell unit 2 has on one side and integral therewith a tubular detonating cord tunnel 4. In alignment with tunnel 4 is a similar tunnel 5 on lower shell unit 3. A detonating cord section 6 is shown passing through tunnels 4 and 5. Sufficient clearance is provided in the tunnels to permit the assembly 1 to slide along cord 6.

Figure 2:
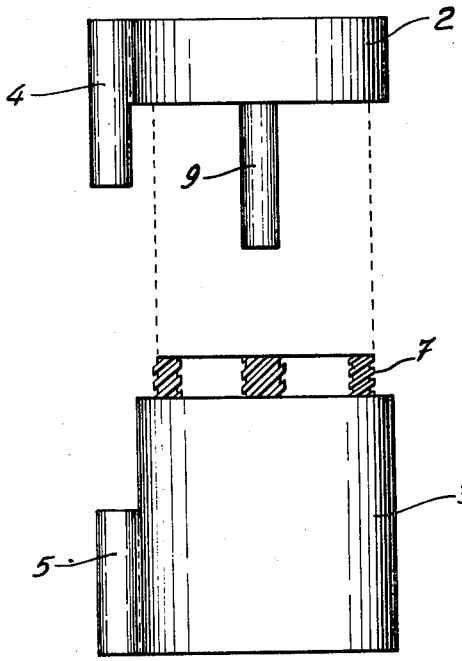
FIG. 2 is an exploded side elevational view of the assembly of FIG. 1 showing the first and second shell units separated.
Figure 3:
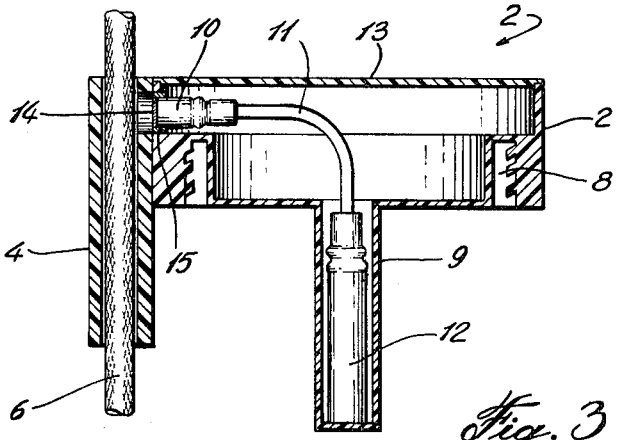
FIG. 3 is a perspective cut-away view of the first shell unit showing the inplaced sensor/signal carrier/-delay cap assembly.

FIG. 2 shows the assembly of FIG. 1 with shell units 2 and 3 separated and disconnected. On the upper surface of lower shell unit 3 is shown a male threaded or lugged skirt portion 7 which is adapted to interlock with a corresponding female threaded or lugged recess 8 within upper shell unit 2 as shown in FIG. 3. A detonator or cap well 9 is shown integral with and projecting downward from upper shell unit 2.

FIG. 3 shows upper shell unit 2 fitted with an assembly comprising a sensor 10, a signal carrier 11 and a delay cap 12. Shell unit 2 comprises a hollow construction of, for example, molded plastic such as polyethylene, polypropylene or PVC having a separate lid portion 13 which lid may be cemented in place with, for example, an epoxy resin after positioning of sensor/signal carrier/cap assembly 10/11/12 within the confines of unit 2. The wall of unit 2 dividing the unit from cord tunnel 4 comprises a thin wall or membrane area 14 against which sensor 10 is held by means of, for example, retainer 15. Sensor 10 may comprise a tubular metal shell containing explosive material such as, for example, lead azide or lead styphanate, which explosive material is sensitive to initiation from the detonation of the detonating cord within tunnel 4. Upon the sympathetic initiation of the explosive material in sensor 10, shock and heat from sensor 10 is transmitted via signal carrier 11 to ignite delay blasting cap 12. Signal carrier 11 may be, for example, a length of hollow plastic tubing of say, 45 mm inside diameter or a length of NONEL (Reg. TM) energy transmission tube. Upon the ignition and detonation of delay cap 12, the adjacent primer charge as shown in FIG. 4 is detonated.

Figure 4:
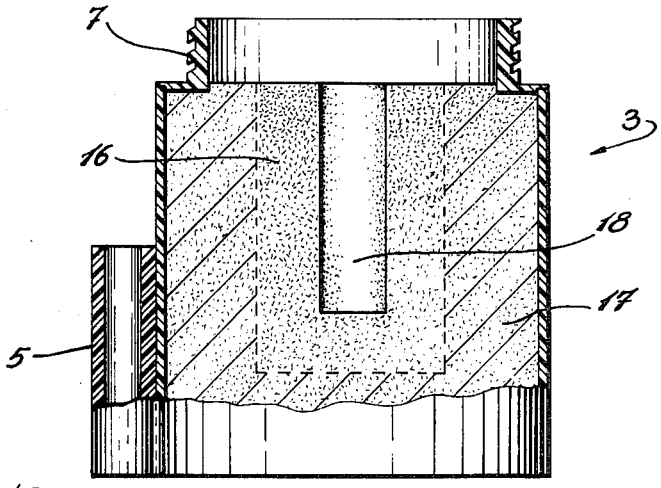
FIG. 4 is a cross-sectional view of the second shell unit showing the cast or pressed primer charge.

FIG. 4 shows lower shell unit 3 which may comprise, for example, a hollow construction of molded plastic, for example, polyethylene, polypropylene or PVC. Within shell unit 3 is shown a typical cast primer charge consisting of an inner sensitive core of an explosive such as pentaerythritol tetranitrate (PETN) 16 surrounded by an outer sheath of a less sensitive explosive such as trinitrotoluene (TNT) 17. The inner core of PETN may be replaced by a blasting cap or detonating cord configuration or other sensitive explosives positioned and imbedded in the cast primary explosive (TNT). Alternatively, the entire primer explosive charge may comprise an explosive mixture such as, for example, pentolite, a mixture of PETN and TNT or Composition B, a mixture of RDX and TNT. Inner cord explosive 16 contains a recess 18 adapted to accommodate cap well 9 of upper shell unit 2. Explosives 16 and 17 are cast or pressed into shell unit 3 using techniques well known in the art.

The threaded or lugged area on skirt portion 7 of lower shell unit and the corresponding or lugged area in recess 8 are so adapted that when the upper and lower shell units are connected, the detonating cord tunnels 4 and 5 are automatically aligned.

Figure 5:
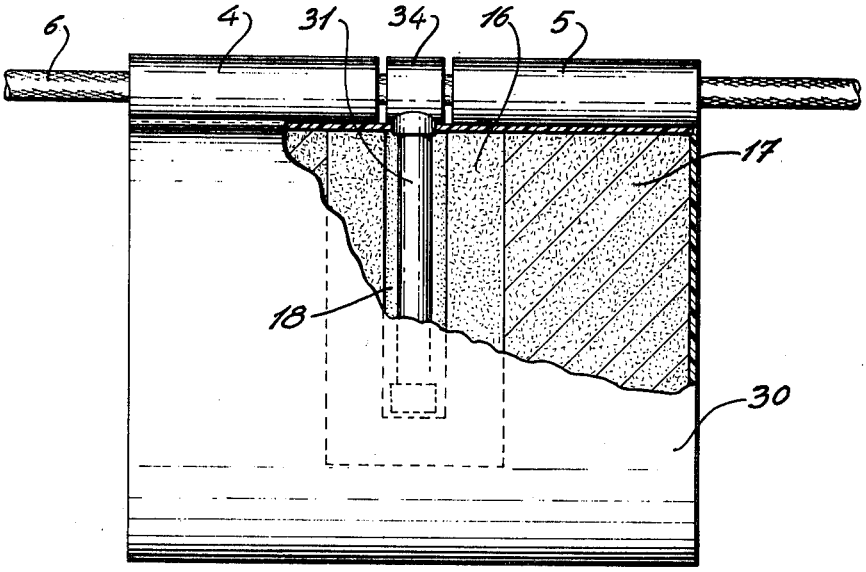
FIG. 5 is a perspective partly cut-away view of an alternative embodiment of the primer assembly of the invention.
Figure 6:
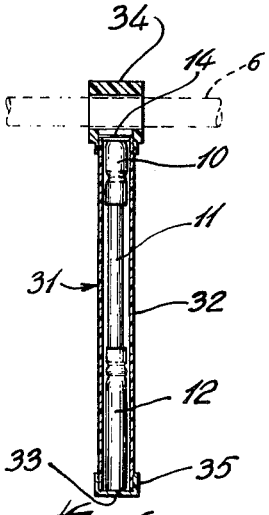
FIG. 6 is a cut-away view of the sensor/signal carrier/delay element used in the primer of FIG. 5.

FIGS. 5 and 6 show an alternative embodiment of the primer assembly of the invention which consists of a hollow shell unit 30 having integral tubular detonating cord tunnels 4 and 5 on one side thereof. Cord 6 is shown passing through tunnels 4 and 5. Within shell unit 30 is shown a cast primer charge comprising an inner sensitive explosive core 16 and a surrounding less sensitive explosive sheath 17. Inner core 16 contains a recess 18 adapted to accommodate a sealed sensor/signal carrier/cap assembly unit 31. Assembly unit 31 consists of a tube 32 having a closed end 33 and containing a sensor 10, signal carrier 11 and delay cap 12. An integral thin wall or membrane 14 seals off tube 32 and protects the sensor/signal carrier/cap elements against moisture or of chemical contaminant penetration. End 33 of tube 32 is shown closed at its bottom end by means of a tight fitting or cemented on cap or plug 35 to produce water-tightness. Alternatively, tube 32 may be constructed in two halves adapted to be screwed or snapped together to enclose the sensor/signal carrier/cap element. At the end of tube 32 and ingral therewith is a short tunnel element 34 corresponding in dimensions to tunnels 4 and 5. Assembly unit 31 is adapted for insertion into recess 18 with tunnels 34 in alignment with tunnels 4 and 5 so that cord 6 may be passed therethrough. The detonation of cord 6 initiates the explosive material in sensor 10 which transmits shock and heat through carrier 11 to ignite cap 12. Cap 12 in turn initiates primer charges 16 and 17. Because of the in-line relationship of cap 12 and sensor 10 in assembly 31, the signal carrier 11 may be eliminated and sensor 10 attached directly to an open end of cap 12 thus simplifying the construction. In this event a slightly elongated cap 12 may be required.

Figure 7:
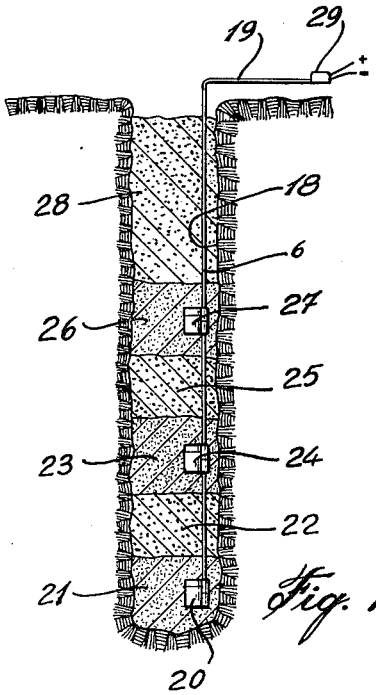
FIG. 7 is schematic view of a borehole charged with explosives and the primer assembly of the present invention.

With reference to FIG. 7, illustrated is a typical borehole in rock charged in deck-loaded fashion and employing the primer assemblies of FIGS. 1 or 5. Shown is a borehole 18 of, for example 30 cm diameter and 15 m depth. Extending into borehole 18 is a detonating cord downline 19 attached to the lower end of which is primer assembly 20 having a delay time of, say, 25 milliseconds. A bulk explosive charge such as a slurry blasting agent, is loaded on and above primer assembly 20 and the charge is in turn covered with inert stemming material 22. A second charge of explosives 23 is loaded above stemming 22 and simultaneous therewith a second primer assembly 24 of, say, 50 milliseconds time dealy, is slid down cord 19 to rest within charge 23. Further stemming 25 is placed over charge 23 and a subsequent explosive charge 26 and primer assembly 27 (75 milliseconds time delay) are loaded in a like manner. A final stemming 28 is placed over charge 26. Downline 19 is initiated by, for example, electric blasting cap 29 and the detonating cord nearly simultaneously initiates the sensor element in each primer assembly. The primer assemblies are in turn initiated in sequence corresponding to their selected time delay intervals, normally but not necessarily from the bottom of the borehole (primer 20) upwards to provide a time controlled blast. Because the sensitive elements of the primer assembly of the invention are protected from moisture in the borehole and from the liquid ingredients of the explosive charge, borehole 18 may be charged many days before its time of detonation without risk of detonation failure and the hazards and expense caused thereby.

I claim:

1. A delay primer assembly comprising a first cup-like shell unit containing a primer explosive charge and a second hollow shell unit having a hollow cylindrical projecting element containing a non-electric delay blasting cap to which is operatively connected a signal carrier and a sensor element, the said delay blasting cap, signal carrier and sensor element being hermetically sealed entirely within the said second hollow shell unit, the first and second shell units being interlockingly interconnectable in such a manner that the said projecting element of the said second hollow shell unit containing the said blasting cap is close-fittingly inserted into a cylindrical receiving recess contained in the said primer explosive charge, the initiation of the said second shell unit blasting cap causing detonation of said first shell unit primer explosive charge, both said first and second shell units having integrally attached to their outer walls aligned guide means by which a detonating cord may be brought into slidable initiating contact with the said sealed sensor element.

2. An assembly as claimed in claim 1 wherein the said shell units and integral cord guide means are comprised of a moldable plastic material.

3. An assembly as claimed in claim 2 wherein the plastic material is selected from polyethylene, polypropylene and polyvinyl chloride.

4. An assembly as claimed in claim 1 wherein the said primer explosive comprises cast or pressed PETN, TNT or mixtures of these.

5. An assembly as claimed in claim 1 wherein the said detonator cord guide means comprise tubular elements.

6. An assembly as claimed in claim 1 wherein the said sensor element is directly connected to the said delay cap.

* * * * *